United States Patent [19]

Gibbs

[11] 4,187,619

[45] Feb. 12, 1980

[54] STRAP FASTENING MEANS FOR A SOCK AND SHOE COMBINATION

[76] Inventor: Don W. Gibbs, 3452 Monte Verde Dr., Holladay, Utah 84109

[21] Appl. No.: 883,677

[22] Filed: Mar. 6, 1978

[51] Int. Cl.[2] ..... A43B 3/10; A41B 11/00

[52] U.S. Cl. ..... 36/10; 2/240; D2/330

[58] Field of Search ..... 2/239, 240, DIG. 6; 36/10, 50, 132, 136; D2/330

[56] References Cited

U.S. PATENT DOCUMENTS

| | | | |
|---|---|---|---|
| 1,176,572 | 3/1916 | Lassig | 36/136 |
| 2,238,804 | 4/1941 | Brown | 36/10 |
| 2,422,410 | 6/1947 | Gross | 36/10 |
| 3,501,777 | 3/1970 | Norman | 2/DIG. 6 |
| 4,055,858 | 11/1977 | Traenkle | 2/240 |

*Primary Examiner*—Patrick D. Lawson

*Attorney, Agent, or Firm*—Thorpe, North & Gold

[57] ABSTRACT

The invention comprises a connector which can be detachably fastened at one end to the rear of a sock at or above the heel region and which can be detachably fastened at the other end to the outside of the rear or heel region of a shoe. This connector, when fastened, completely restrains riding or sliding of the sock into the shoe.

8 Claims, 6 Drawing Figures

STRAP FASTENING MEANS FOR A SOCK AND SHOE COMBINATION

The present invention relates to a means for fastening a sock to a shoe to prevent relative movement thereof. More specifically, the present invention relates to a connector which can be fastened to one end to the rear or heel area of a sock and on the other end to the outside of the rear or heel area of a shoe to prevent the sock from riding, slipping or otherwise working into the heel cavity of the shoe during activity by the person wearing the sock and shoe. The connector is separate from the sock and shoe, and consequently, the sock and/or shoe need no special modification.

BACKGROUND OF THE PRIOR ART

Sports participants and particularly track and field participants often participate without gym socks on their feet for the reasons that gym socks, particularly those having tubes or hoses that extent above the ankle of the wearer, add weight to the participant, particularly as perspiration is absorbed by the sock, and retain body heat. Added weight and heat retention are especially disadvantageous for long-distance runners. Oftentimes, the decision not to wear gym socks is dictated by these reasons rather than by comfort, since wearing athletic shoes without socks is not particularly comfortable to the wearer.

An alternative to tube socks is tubeless socks of short-length, which generally are cut below the ankle of the wearer. These socks decrease weight and heat retention, and they are also stylish, especially for the female participants in sports such as golf and tennis, in which the participant generally prefers not to wear socks having tubes extending above the ankles. However, the use of these short-length socks is less than desirable in many instances because they tend to ride or slide into the heel cavity of the athletic shoe as the wearer walks or runs (this will happen with standard-length socks in many instances). Consequently, some persons will not wear even short-length socks.

Some attempts have been made to prevent or minimize the extent of riding, sliding, or working of the heel portion of a short-length sock into the heel cavity of a shoe. Some socks primarily designed for female wearers contain tassels extending from the top (the collar or opening) of the heel of the sock. These tassels lay over the back of the athletic shoe and are intended to provide some resistance to the riding or sliding down of the heel of the sock into the shoe. However, because these tassels are not immovably affixed to the outside of the heel area of the shoe, the sock still tends to ride into the shoe. In fact, this riding action can occur with sufficient force to break the tassels and to continue with no resistance whatsoever. Another attempt has been to fold an extension of the top or collar of a short-length sock down over the top of a shoe. Still another attempt has been to provide an elastic neck at or near the collar of the sock to attempt to prevent slippage. These attempts also suffer from the deficiency that although some resistance to slippage may occur, slippage is not totally prevented. Furthermore, these attempts have not always worked satisfactorily.

One attempt has been made to fasten the sock to the shoe, and this was by providing a fastening means contained on the sock or shoe or both. See U.S. Pat. No. 2,238,804. This attempt suffers from the disadvantage that modifications must be made to either the sock or shoe or both and thus special socks and/or shoes are required. Moreover, this patent discloses attaching the turned-down collar of a short-length sock to the sides of a shoe. This mode of attachment does not prevent the back or heel of the sock from riding into the shoe.

The present invention overcomes the above-described problems and disadvantages. It allows a person to wear a sock which will not at the heel or other region ride or slide into the shoe of the wearer. Of particular importance, the present invention does not require specially modified socks and/or shoes. This allows universal application. The invention comprises a connector which can be detachably fastened at one end to the rear of the sock at or above the heel region and which can be detachably fastened at the other end to the outside of the rear or heel region of a shoe. This connector, when fastened, completely restrains riding or sliding of the sock into the shoe.

SUMMARY OF THE INVENTION

The present invention is a connector having a fastening means on one end for detachably fastening to a sock at or above its heel region and a fastening means on the other end for detachably fastening to the outside of the rear or heel region of a shoe to prevent the sock from sliding or riding into the shoe. The present invention also includes a sock and shoe combination fastened together by the connector and the method of fastening the sock and shoe together by the connector.

BRIEF DESCRIPTION OF DRAWINGS

As shown in FIGS. 1 and 2, the connector 1 of the present invention comprises a body portion 2 and ends 3,4 and 5. Ends 3 and 4 contain sock fastening means 6 and 7, which are shown as hook fasteners, for fastening to a sock. Either end 5 or body portion 2 contains shoe fastening means 8, shown as an adhesive pad, for fastening to a shoe. The connector 1 is shown in its preferred Y-shaped form. This form or shape allows for two-directional tension on the collar of the sock as shown in FIGS. 4, 5, and 6. This dual tension better restrains the heel area of the sock from slipping into the shoe. However, the connector 1 can be of many different configurations, such as rectangular or triangular, and can have singular as well as plural sock and shoe fastening means. Preferably, the connector 1 is flexible so that it can be fastened more easily to the sock and shoe and so that it can better conform to the shape of the shoe. The material of the connector is not critical and cloth or other fabric can be used.

Figure 1:
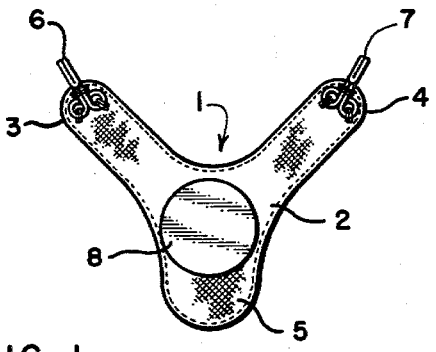
FIG. 1 is a front elevational view of the connector of the present invention showing a hook fastening means on one end and an adhesive fastener on the other end.
Figure 2:
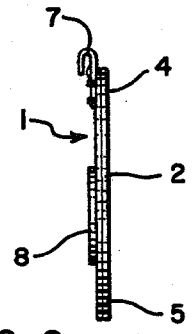
FIG. 2 is a side elevational view of the connector.
Figure 3:
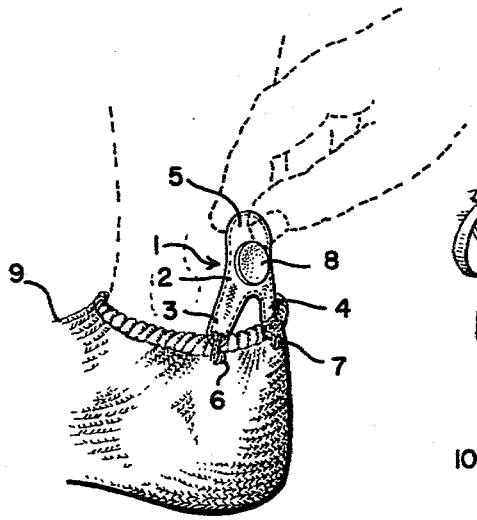
FIG. 3 is a perspective view showing the connector being fastened to a sock.
Figure 4:
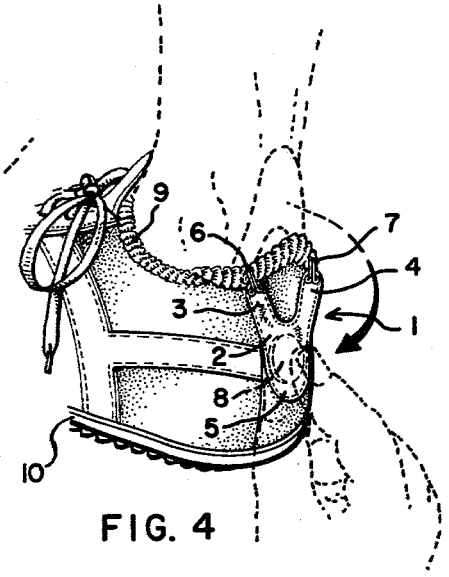
FIG. 4 is a perspective view showing the collar of the sock being pulled over and then down the top of a shoe for fastening to the shoe.

The sock fastening means 3 and 4 are designed to engage a sock. For example, hook fasteners penetrate the material of the sock as shown in FIGS. 3 and 4. Other fasteners could be used as small alligator clips which would clip the material of the sock. As mentioned, the connector preferably is attached at or above the heel region of the sock. Preferably, the attachment would be at or near the collar of a tubeless or short-length sock as shown in FIGS. 3–6. However, the invention also is applicable to a standard tube sock in which event the connector would be attached either to the collar of the tube, if high-top shoes or boots were worn, or to the base of the tube portion of the sock at or above the heel portion, if low-cut shoes were worn.

The shoe fastening means 8 is preferably an adhesive or a Velcro fastener. An adhesive fastening means simply can be pressed against the shoe and will adhere to it. A Velcro fastener is widely used for various fastening application. It comprises synthetic materials that adhere when pressed together.

Figure 5:
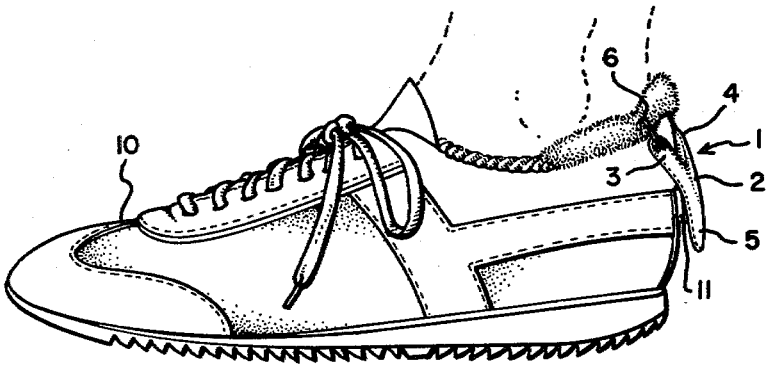
FIG. 5 is a side elevational view showing a sock and shoe fastened together by the connector of the present invention.
Figure 6:
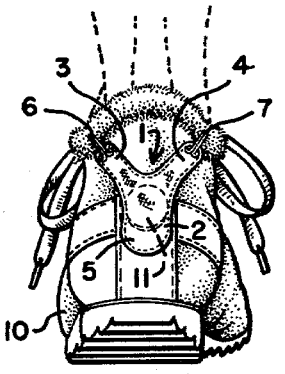
FIG. 6 is an end elevational view of a sock and shoe fastened together by the connector of the present invention.

More specifically, a Velcro fastener comprises opposing patched attached to opposing parts of an article(s) (in the present instance, a connector and a shoe). One patch contains numerous small loops (similar to terry loops), and the other patch contains short, stiff, curved bristles that engage the loops and cause the patches to adhere when the patches are pressed together. This type of fastener is especially effective in restraining horizontal movement of the patches relative to each other. When a Velcro fastener is used, one patch is affixed to the connector and the mating patch is affixed to the shoe. A Velcro fastener with shoe patch 11 is shown in FIG. 5. The connector comes equipped with both patches, and the shoe path can contain an adhesive backing for easy attachment to any shoe. Thus, the shoe does not require any special modification. A similar arrangement can be made using a hook-and-eye fastener with either the hook or the eye having an adhesivebacked base which is attached to the heel of the shoe. This arrangement also could be accomplished with a snap fastener, which comprises a ball part that engages a socket part. An elongated patch on either the connector or the shoe will allow for variable positioning of the opposing patch and thereby for variable adjustment of the point of attachment of the connector with respect to the rear heel of the shoe.

Regardless of the particular fastening means employed, it should prevent movement of the connector relative to the shoe and thereby restrain movement of the sock.

FIG. 3 illustrates the method of fastening the connector 1 to the sock 9 worn within shoe 10. Hook fasteners 3 and 4 are forced into the material of the sock 9.

FIG. 4 illustrates the method of fastening the connector 1 to the shoe 10, after it has already been fastened to the sock 9. Preferably, the connector 1 is used to pull the collar of the sock 9 over the top of the heel of the shoe and part way down the shoe as shown. This provides sufficient tension to prevent the collar of the sock from moving into the shoe and prevents the fastening means 3 and 4 from contacting the wearer's skin. Moreover, by pulling the collar of the sock over the top of the shoe, greater resistance to slippage is provided. The fastening means 8 is an adhesive pad that adheres to the shoe.

The fabric and configuration of the sock are immaterial. The invention will work with thin socks (such as nylon socks) as well as with thick, gym or sweat socks. The invention is particularly advantageous for use with shortlength socks (i.e., socks that extend to or slightly above the level of the top of a regular or low-cut shoe) because such socks cause considerable discomfort when they slip or work into a shoe. The sock may have an enlarged, bulky or fluffy collar or none at all.

The type and configuration of the shoe similarly are immaterial. Although the present invention primarily is designed to be used with a low-cut shoe, it is adaptable to high-top shoes or boots that usually are worn with tube socks. With high-top shoes or boots, the connector would be attached to the top or near the top of the tube of the sock at its collar and to the shoe somewhat above the heel region of the shoe.

Almost any sock-shoe combination can be used since neither the sock nor the shoe needs any modification. This is the most important advantage of the invention. The connector is detachably fastenable to both the sock and the shoe and can be provided separately. If, as explained above, an adhesive-backed patch is attached to a shoe as a part of the shoe fastening means of the connector, the patch can be supplied with the connector and simply pressed against the shoe to adhere to it.

While the present invention has been described with reference to certain illustrative and preferred embodiments, various modifications will be apparent to those skilled in the art and any such modifications are intended to be within the scope of the invention as set forth in the appended claims.

What is claimed is:

1. A connector for fastening a sock to a shoe, the connector having opposite ends and a fastening means on one end for detachably grasping a sock at or above its heel region and a fastening means on the other end for detachably adhering to the outside rear or heel region of the shoe, which connector, when fastened prevents the sock from sliding or riding into the shoe during activity by the wearer of the sock and shoe.

2. A connector according to claim 1 wherein the sock fastening means is a hook for engaging and grasping the sock.

3. A connector according to claim 1 wherein the shoe fastening means includes an adhesive disposed on said other end of the connector for containing and adhering to the shoe.

4. A connector according to claim 1 wherein the connector is Y-shaped with the forked ends each containing the sock fastening means and the other end containing the shoe fastening means.

5. A connector according to claim 1 wherein the connector is of a length so that when attached to the sock and shoe, the sock is pulled over the back heel portion of the shoe.

6. A method of preventing a sock from riding or sliding into the heel cavity of a shoe during activity by the wearer of the sock and shoe, which comprises the steps of detachably fastening one end of a connector, which has opposite ends, to the heel region or above of a sock and the other end to the outside of the rear or heel region of a shoe, which connector has an adhesive on the shoe fastening end and a grasping element on the sock fastening end.

7. A sock and shoe combination in which the sock and shoe are detachably fastened together by a connector having opposite ends and a sock fastening means on one end and a shoe fastening means on the other end, the connector being detachably fastened by a grasping element to the sock at or above its heel region and by an adhesive to the outside of the rear heel region of a shoe, such connector preventing the sock from sliding or riding into the shoe during activity by the wearer.

8. A connector according to claim 1 wherein the shoe fastening means includes a Velcro fastener.

* * * * *